US005282434A

United States Patent [19]

Hart et al.

[11] Patent Number: 5,282,434

[45] Date of Patent: Feb. 1, 1994

[54] BOAT MOORING DEVICE

[75] Inventors: Andrew J. Hart, Downsview; Daniel L. Bressanutti, Kleinberg; Roderick J. Melson, Fenelon Falls, all of Canada

[73] Assignee: Bear Industries Inc., Kleinberg, Canada

[21] Appl. No.: 992,975

[22] Filed: Dec. 18, 1992

[51] Int. Cl.[5] ..... B63B 21/00

[52] U.S. Cl. ..... 114/230

[58] Field of Search ..... 114/221 R, 230, 365, 114/368, 369, 370, 372, 263

[56] References Cited

U.S. PATENT DOCUMENTS

| | | | |
|---|---|---|---|
| 3,151,595 | 10/1964 | Stainbrook | 114/230 |
| 3,157,150 | 11/1964 | Faber, Jr. | 114/230 |
| 3,177,838 | 4/1965 | Grimes | 114/230 |
| 3,195,498 | 7/1965 | Johns | 114/230 |
| 3,464,214 | 9/1969 | King | 114/230 |
| 4,250,827 | 2/1981 | Booker et al. | 114/230 |
| 4,699,075 | 10/1987 | Tortorici | 114/230 |

*Primary Examiner*—Edwin L. Swinehart
*Attorney, Agent, or Firm*—Bereskin & Parr

[57] ABSTRACT

A boat mooring device designed to be used with a second similar mooring device to hold a boat away from a dock while allowing up and down movement of the boat in response to water level changes. In a preferred embodiment, each mooring device has an arm that extends out from the dock and is coupled to a base for movement about both a generally horizontal axis permitting lateral swinging of the arm, and a vertical axis permitting up and down movement of the arm. The two movements are cushioned by a tension spring that is connected between the base and the inner end of the arm so that the spring is tensioned whenever the arm moves down or swings laterally from a rest position.

11 Claims, 4 Drawing Sheets

BOAT MOORING DEVICE

FIELD OF THE INVENTION

This invention relates generally to mooring devices for boats.

BACKGROUND OF THE INVENTION

Mooring of a boat at a dock or the like presents a number of problems. The boat can be simply tied to the dock by ropes. However, if the ropes are loose, the effect of wave or wind action may cause the boat to bump against the dock. This can result in damage to the boat and/or to the dock. If the boat is tightly tied to the dock, on the other hand, the boat cannot readily move to accommodate variations in water level, at least without the boat rubbing against the dock, again with potential risk of damage. If the water is subject to tidal fluctuations, this can be quite a serious problem and may require the mooring ropes to be adjusted periodically during the day. However, even on lakes or rivers not subject to tidal fluctuations, water level changes caused by the wake of passing boats, can cause quite a severe rubbing action between the boat and the dock. On waterways that are subject to heavy traffic, this in itself is a significant problem.

The problem can be avoided by mooring the boat to a mooring buoy offshore but this brings with it the difficulty of getting into and out of the boat. For example, it may be necessary to use a separate dinghy to transport passengers between the moored boat and the shore. Even then, the problem of accommodating water level fluctuations remains.

An object of the present invention is to provide an improved boat mooring device that addresses these problems.

SUMMARY OF THE INVENTION

According to the invention there is provided a boat mooring device which includes a mooring arm for extending between a boat and a mooring location, a base for supporting the arm at the mooring location and means coupling the arm to the base so as to permit pivotal movement of the arm with respect to the base about both an upright axis and a generally horizontal axis. Movement of the arm about the upright axis permits lateral swinging movement of the arm, to accommodate movement of a moored boat towards and away from the mooring location while movement about the generally horizontal axis permits up and down movement of the arm for accommodating up and down movement of the boat. Spring means is provided for normally maintaining the arm in a rest position about both of the axes.

Normally, boat mooring devices of the type provided by the invention will be used at least in pairs. The devices will be installed on a dock or other supporting surface so that the two mooring arms extend out over the water generally at right angles to the edge of the dock or the like. The boat is moored to the outer ends of the arms by ropes or other connectors.

The arms hold the boat away from the dock so that the boat cannot hit or rub up and down against the dock under the effect of wave or wind action. The arms can move up and down to accommodate up and down movement of the boat for example due to the wake of another boat passing by. The arms can also accommodate water level changes due to tidal effects, within limits, and depending on the length of the arms.

To board the boat, it is merely necessary for the person standing on the dock to reach out and pull on one of the mooring arms. The arm will pivot laterally about its upright axis, pulling the boat in towards the dock and allowing passengers to board. When the arm is released, the spring means will automatically move the arm back towards its initial position, pushing the boat away from the dock. The boat can then be untied or unhooked from the arms. Depending on the design of the arms and the spring means, the arms may automatically retract upwardly as the boat is untied, by pivoting about their respective horizontal axes.

Conversely, when docking, the boat is manoeuvred close to the dock and the passenger or passengers disembark. A person standing on the dock pulls in each of the mooring arms in turn and the boat is attached to the relevant arm. When released, the arms return under the influence of the spring means, and move the boat away from the dock.

Preferably, a single coil spring such as a tension spring is used to resist movement of the arm about both the upright and generally horizontal axes. In a preferred embodiment, the mooring arm has an outer end provided with means for attaching a boat to the arm, and an inner end, and the arm is coupled to the base at a location intermediate its ends and closer to the inner end than to the outer end. The coil spring extends between the inner end of the arm and the base and normally maintains the arm in its rest position. The spring is then extended by downward movement of the outer end of the arm or by lateral swinging movement of the arm from its rest position, or both, so that the same spring can resist up and down or lateral swinging movement of the arm or both.

BRIEF DESCRIPTION OF THE DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
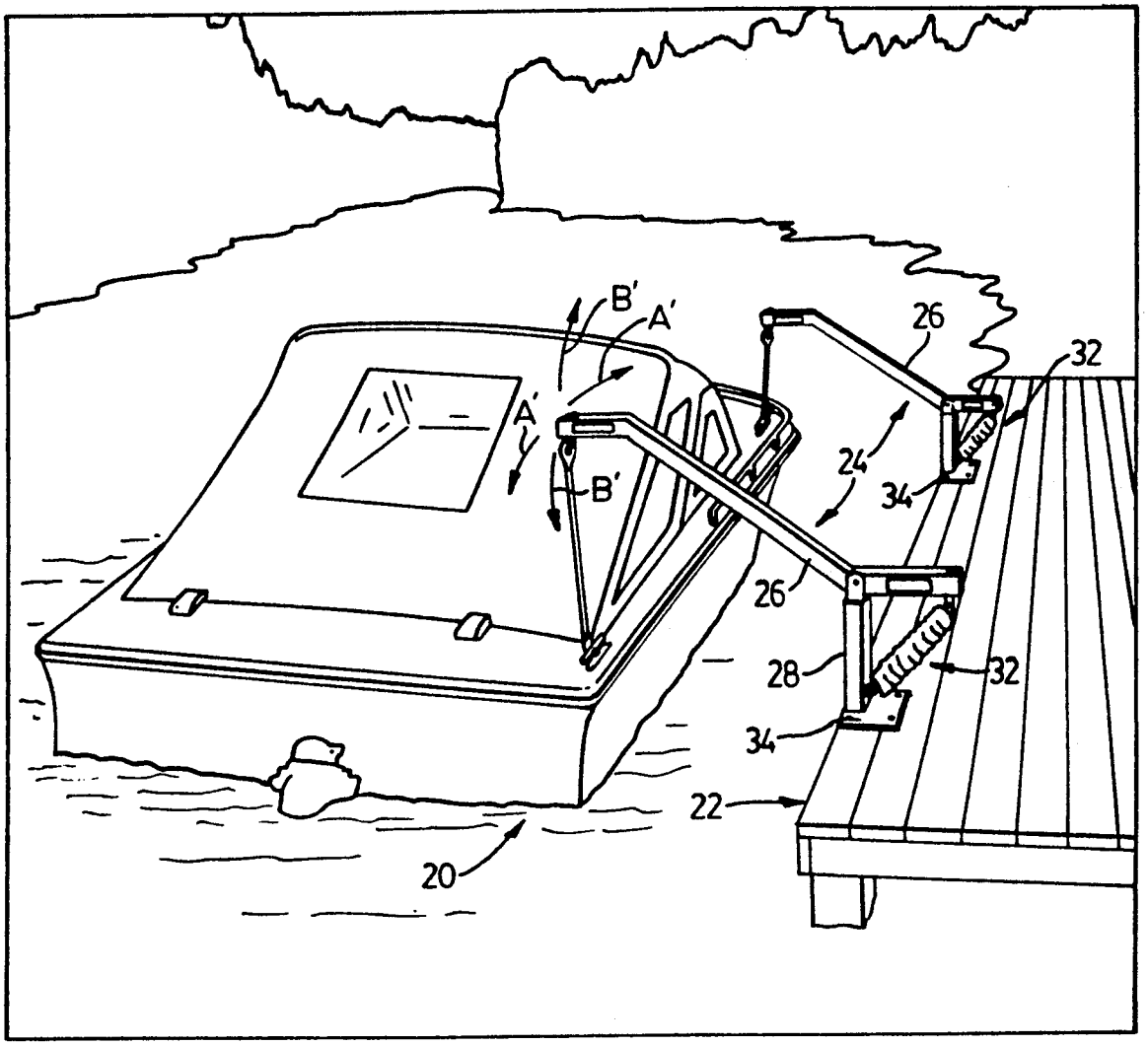
FIG. 1 is a perspective view showing a boat moored at a dock using two mooring devices of the form provided by the invention.

Referring first to FIG. 1, a boat 20 is shown moored at a dock 22 by means of two mooring devices, each of which is denoted by reference numeral 24. The two devices are identical. As noted previously, the devices will almost always be used in pairs although three, four or even more of the mooring devices could be used for a single boat if necessary.

Figure 2:
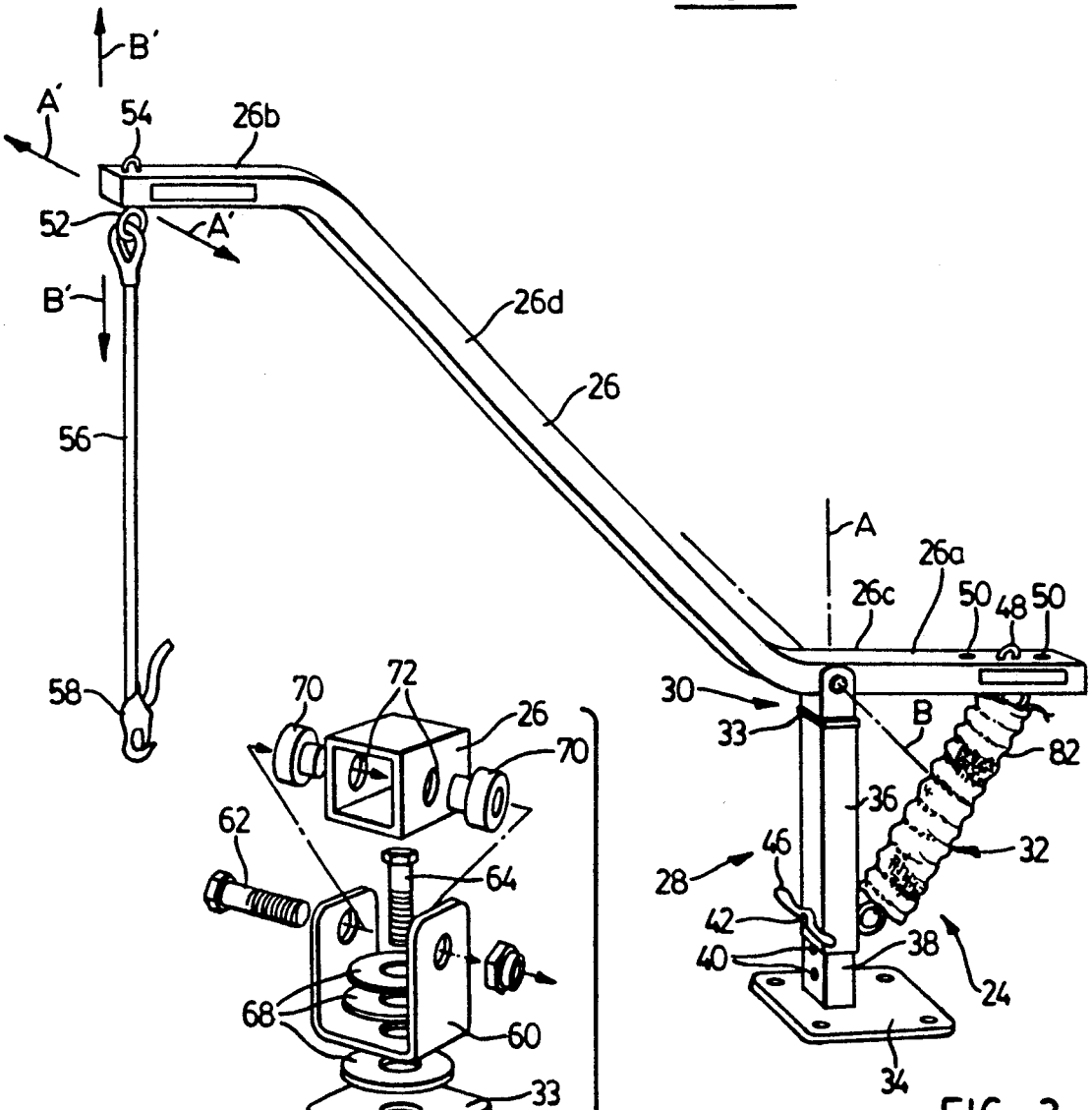
FIG. 2 is a perspective view in more detail of one of the mooring devices shown in FIG. 1.

Referring now to FIG. 2, the principal components of the device are a mooring arm 26 for extending between the dock and the boat (see FIG. 1), a base 28 for supporting the arm on the dock, a pivotal coupling 30 between the base and the arm, and a tension spring 32. The spring is shown enclosed in a protective sleeve; in FIG. 5 (to be described), the spring and sleeve are shown separately.

Arm 26 has inner and outer ends 26*a* and 26*b* respectively and is coupled to the base 28 at a location 26*c* which is intermediate the two ends and closer to the inner end 26*a* than to the outer end 26*b*. The length of the arm and its particular configuration may vary depending, for example, on the size and type of the boat to be moored but the shape of the arm as seen in FIG. 2 is preferred for relatively small pleasure boats (e.g. 700 Kg in weight).

It will be seen that the arm has portions adjacent the inner and outer ends respectively that are parallel to one another and that the end portions are joined by an intermediate portion 26*d* that makes an obtuse angle with each of the end portions. As will be described in more detail later, the mooring device is designed so that it will normally adopt a rest position under the influence of spring 32. In that position, the end portions of the arm are generally horizontal and the intermediate portion is inclined upwardly from the base so that the outer end of the arm is above the boat when it is moored, as best seen in FIG. 1. The arms remain in their respective rest positions or, preferably, retract upwardly after the boat has been untied and driven away. The arms should then be reasonably clear of obstructing either the returning boat or other traffic on the waterway. Base 28 should be relatively low and the arm outwardly of the base should be reasonably accessible to a person standing on the dock so that the arm can be pulled in to bring the boat close to the dock.

In this particular embodiment, the arm comprises a length of rectangular box section metal tubing formed to the shape shown in the drawings and provided with protective end caps (not shown).

Base 28 can comprise a length of similar tubing with plates welded transversely across its respective ends, forming a top plate 33 for receiving coupling 30 and a base plate 34 designed to be bolted to a dock or other support surface. The base would then have a fixed height. Preferably, however, the base is adjustable in height and comprises two rectangular section tubes 36 and 38 designed to telescope one within the other. As shown in FIG. 2, an inner one of these tubes, 38, extends upwardly from base plate 34 and is provided with a series of vertically spaced openings 40 that extend through the front and rear faces of the tubing and are aligned with one another. The outer tube 36 is vertically slidable on tube 38 and the top plate 33 is welded to the outer tube.

Figure 5:
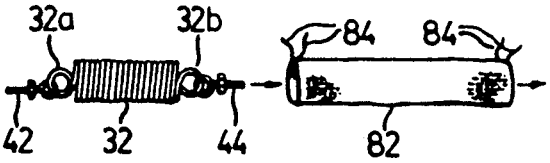
FIG. 5 is a detail view showing the spring means of the device.

As best seen in FIG. 5, respective eye bolts 42 and 44 are provided at the opposite end of spring 32. Referring back to FIG. 2, eye bolt 42 extends through a pair of aligned openings in the front and rear faces of the outer tube 36 and the projecting outer end portion of the bolt is provided with a wing nut 46. In addition to anchoring the spring, eye bolt 42 also serves to hold the two tubes 36 and 38 in the appropriate relative vertical positions with respect to one another. Thus, the bolt extends through the appropriate one of the openings 40 in the inner tube 38 also.

Preferably, the attachment point for the spring to the base is fixed in relation to the coupling 30 so that the spring rate does not change depending on the height of the base. FIG. 2 shows one way of accomplishing this but there are other possibilities. For example, in another embodiment, it may be desirable to avoid using the spring eye bolt to both attach the spring and as a bolt between the two tubes. Thus, in an alternative embodiment, the spring could be attached to the tube 36 in the same fashion as is shown in FIG. 2 but above the top of the inner tube 38, or the spring could be anchored to a ring welded to the tube 36. A separate bolt or simply a pin through the openings in the tubes could then be used. The arrangement could also of course be reversed with the outer tube on the base plate 34 and the inner tube supporting the top plate 33. It would then be necessary to attach the spring to the inner tube above the outer tube, or to provide means for adjusting the spring tension depending on the height of the base.

In any event, in the illustrated embodiment, the eye bolt at the opposite end of the spring 32 merely extends through openings in the inner end portion of arm 26 and is provided at its outer end with a nut 48. A selection of holes can be provided in the arm to permit adjustment of the position of eye bolt 44. For example, holes for accommodating to other possible positions of the eye bolt 44 are indicated at 50.

Adjacent its outer end 26*b*, arm 26 is provided with a further eye bolt, denoted 52, which is held in place by a nut 54. Eye bolt 52 provides an attachment point for a mooring rope or cable 56 provided with a quick release clasp 58 at its outer end.

As noted previously, arm 26 is coupled to base 28 so as to permit pivotal movement of the arm with respect to the base about both an upright axis and about a generally horizontal axis. In FIG. 2, the upright axis is generally indicated at A and the horizontal axis at B. It will be appreciated that pivotal movement about axis A allows the arm to swing laterally to accommodate movement of a moored boat towards and away from the dock, as indicated by the arrows A' in FIGS. 1 and 2. Such movement, in either angular direction, will of course result in spring 32 being extended, resisting the movement. The arm can also move about the horizontal axis B in response to up and down movement of the boat, as indicated by the arrows B' in FIGS. 1 and 2. Again, such movement will result in spring 32 being extended, resisting the movement. At the same time, a person standing on the dock (FIG. 1) can simply grasp one of the arms and pull it towards the dock, bringing the part of the boat that is attached to the arm close to the dock, for boarding purposes. When the arm is released, it will automatically return the boat to the former position clear of the dock.

Figure 3:
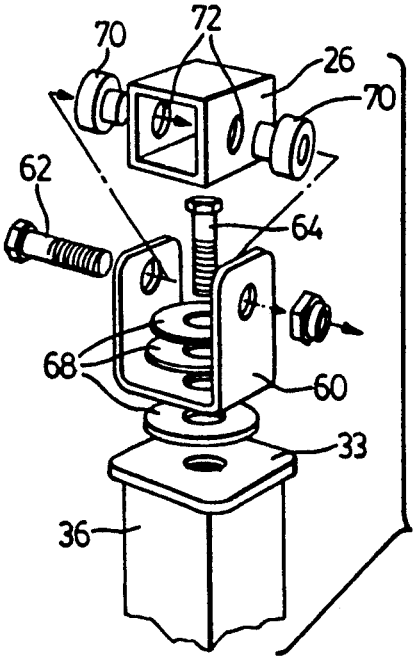
FIG. 3 is an exploded perspective view showing the yoke assembly between the mooring arm and the base of the device.

FIG. 3 is an exploded perspective view of the yoke assembly 30 between the base 28 and the arm 26. In FIG. 3, part only of arm 26 has been shown. Also visible is part of the outer tubular member 36 of the base 28 and the plate 33 at the top of that member.

Arm 26 is embraced by a yoke 60 that is pivotally coupled to the arm by a bolt 62. Bolt 62 defines the generally horizontal axis B (FIG. 2). The yoke 60 itself is coupled to the base 28 by a bolt 64 that defines the upright axis A (FIG. 2). It will be seen that bolt 64 extends through an opening in the base of the yoke 60 and through a corresponding opening in the top plate 33 on the base tube 36. A self-locking nut 66 is welded to the underside of top plate 33 and receives the bolt 64. Suitable washers 68 are provided between the yoke and top plate and below the head of the nut.

Bolt 62 extends through respective bushes 70 fitted into aligned openings 72 in the side walls of arm 26. Bolt 62 is fitted with a self-locking nut 74.

To summarize, lateral swinging motion of the arm 26 is permitted by turning of yoke 60 on bolt 64, while up and down movement of arm 26 is permitted by pivotal movement of the arm on bolt 62 (with bushes 70 in between).

Figure 4B:
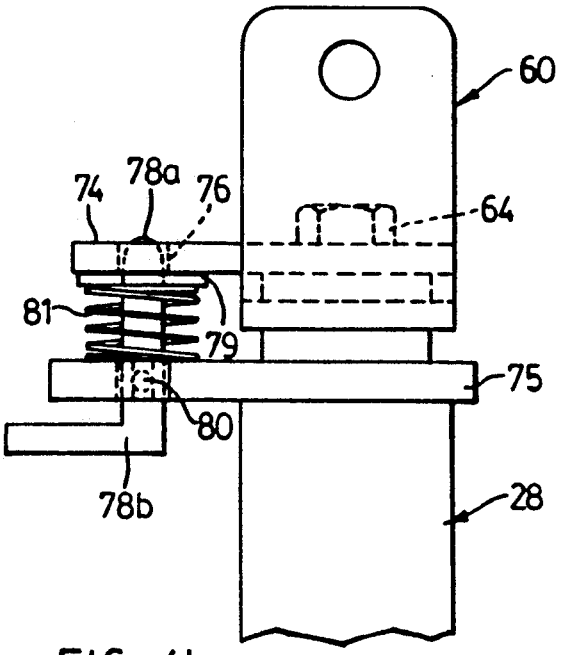
FIG. 4 comprises a perspective view denoted (*a*) and side views (*b*) and (*c*) illustrating a modified form of yoke assembly.
Figure 4C:
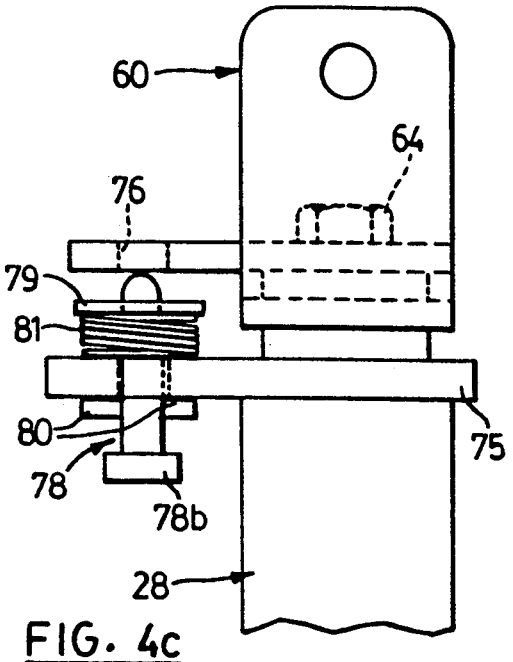
Figure 4A:
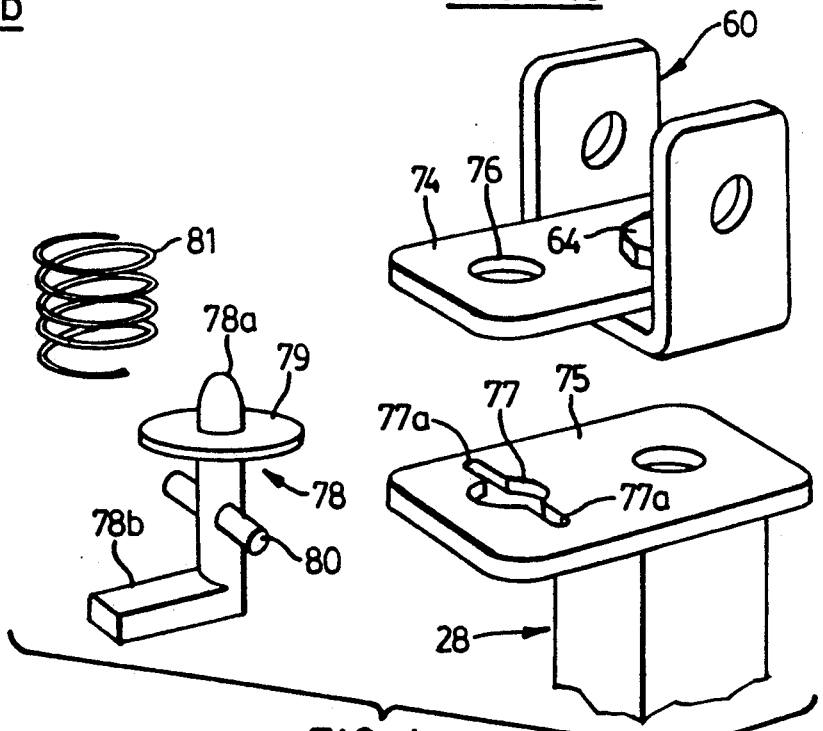

In the embodiment just described, lateral swinging movement of arm 26 is cushioned by spring 32. FIG. 4 illustrates a modified form of yoke assembly which is designed to permit the arm to be locked against such movement, thereby positively preventing the boat being driven against the dock in exceptionally high winds or other adverse weather conditions. FIG. 4(*a*) is an exploded perspective view of the yoke assembly while FIGS. 4(*b*) and (*c*) are assembled views showing locked and unlocked positions respectively.

Referring first to FIG. 4(*a*), yoke 60 is provided with a lateral extension plate 74 that projects outwardly from the base of the yoke and overlies a somewhat similar plate 75 forming a top plate of the base 28. Corresponding openings 76 and 77 are provided in the respective plates for receiving a locking pin 78 that can be engaged in both of the openings for locking the yoke with respect to the base, as shown in FIG. 4(*b*).

As best seen in FIG. 4(*a*), pin 78 is generally L-shaped. The pin has a vertical limb 78(*a*) that is engageable in the openings 76 and 77 in the two plates, and a horizontal limb 78*b* by which the pin can be manipulated. The vertical limb of the pin is provided with a fixed washer 79 at a spacing below the top end of the limb and with transverse projections 80 at a spacing below the washer. The locking pin is fitted to the top plate 75 of base 78 so that the vertical limb 78*a* of the pin extends through opening 77 in plate 75 with washer 79 above plate 75 and the projections 80 below the plate. A compression spring 81 extends between plate 75 and the captive washer 79 so that the pin is biassed upwardly by the spring. The opening 77 in plate 75 is provided with a pair of lateral slots 77*a* which can accommodate the projections 80 on the vertical limb 78*a* of pin 78. Accordingly, if pin 78 is turned so that the projections 80 enter the slots 77*a*, the pin is displaced upwardly by the compression spring 81 and will engage in the opening 76 in plate 74 (assuming that yoke 60 is in an appropriate angular orientation with respect to base 28). Yoke 60 and, with it, arm 26 are then locked against lateral turning with respect to the base 28. This locked condition is illustrated in FIG. 4(*b*).

Conversely, pin 78 can be displaced downwardly by means of limb 78*b*, and the pin turned so that the projections 80 no longer register with the slots 77*a* in the base top plate 75. Pin 78 is then held so that its upper end is below the yoke extension plate 74, allowing the yoke to turn freely with respect to the base.

FIG. 5 shows spring 32 and it will be seen that the spring is essentially a conventional helical coil spring designed to work in tension. Integral loops 32*a* and 32*b* at the ends of the spring accept the eye bolts 42 and 44. In the assembled mooring device, the spring is covered by a sleeve 82 having ties 84 at its ends by which the sleeve is secured to the loops at the ends of the spring. The sleeve in effect provides a shield against anything becoming trapped between the coils of the spring as they open and close when the mooring device is in use.

Figure 6:
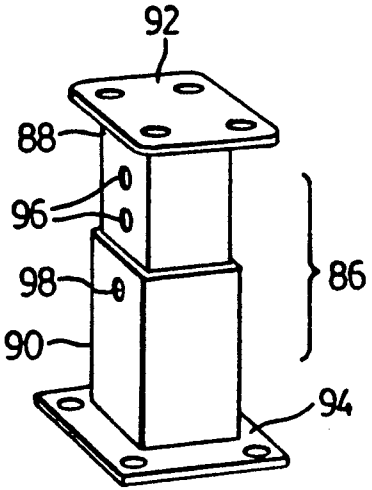
FIG. 6 is a perspective view of an extension stand that may be used with the device; and, FIG. 7 shows, in FIG. 7(*a*) a side dock mounting bracket and, in the views denoted (*b*) and (*c*) two applications of the bracket of FIG. 7(*a*).

FIG. 6 shows a telescopic extension stand 86 that may be used to increase the overall height of the mooring device. Stand 86 comprises telescoping rectangular members 88 and 90, fitted with respective end plates 92 and 94. Member 88 is provided with a longitudinally extending series of aligned openings 96 that can be matched with a pair of similar openings 98 in member 90 for receiving a bolt or pin (not shown) to fix the height of the stand. Top plate 92 is designed to match the base plate 34 of base 28 (FIG. 2), while plate 94 is designed to be bolted to a dock or other support surface. In other words, the extension stand 86 is designed to be interposed between the dock and base plate 34 of the mooring device. The two plates 34 and 92 are bolted together through matching holes.

Figure 7B:
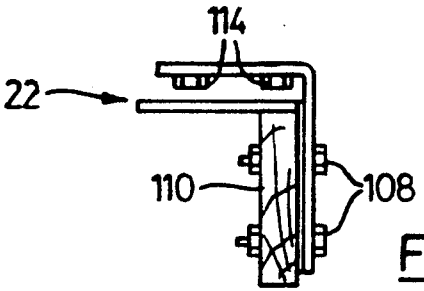
Figure 7C:
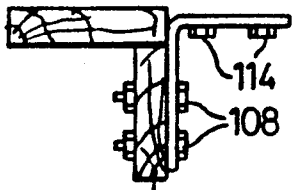
Figure 7A:
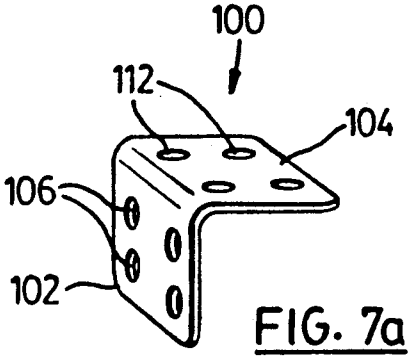

FIG. 7 shows a side dock mounting bracket 100 that can be used in conjunction with boat mooring device, with or without the extension stand 86, to mount the mooring device on the side of a dock or other support, as shown in FIG. 7(*b*) or (*c*). It will be seen that bracket 100 has a vertical limb 102 and a horizontal limb 104. Vertical limb 102 has a series of plain openings 106 for receiving bolts 108 for securing the bracket to a vertical face member 110 of a dock 22 as seen in FIG. 7(*b*) and (*c*). The horizontal limb 104 of bracket 100 has a series of similar openings 112 but in this case, each opening has associated therewith a captive nut 114 at the underside of the limb for receiving a bolt introduced through the opening from the top, so that either the base plate 94 of extension stand 86 or base plate 34 of the mooring device itself can be bolted to the bracket. FIG. 7(*b*) and (*c*) show that the bracket 100 can be secured to the dock in either of two overhanging positions, above the dock (*b*) or outwardly of the dock (*c*).

It will of course be appreciated that the preceding description relates to a particular preferred embodiment of the invention only and that many modifications are possible within the broad scope of the invention. Some of those modifications have been specifically indicated previously and others will be apparent to a person skilled in the art. It should be noted in particular that, while it is preferred to use a single spring (as spring 32) to restrict both horizontal swinging movement of the mooring arms and up and down movement of the arms, separate springs could be used within the broad scope of the invention. For example, individual torsion springs could be used to cushion movement of the mooring arm about the respective axes A and B.

We claim:

1. A boat mooring device comprising:

a mooring arm for extending between a mooring location and a boat;

a base for supporting the arm at said mooring location;

means coupling the arm to the base so as to permit pivotal movement of the arm with respect to the base about both an upright axis, permitting lateral swinging movement of the arm to accommodate movement of a moored boat towards and away from the mooring location, and about a generally horizontal axis permitting up and down movement of the arm for accommodating up and down movement of the boat; and, spring means normally maintaining the arm in a rest position about both of said axes;

wherein the mooring arm has an outer end provided with means for attaching a boat to the arm, and an inner end, and wherein the arm is coupled to said base at a location intermediate said ends and closer to said inner end than to said outer end, and wherein said spring means comprises a single coil spring extending between said inner end of the arm and said base, said spring being arranged to normally maintain the arm in said rest position and to be extended by downward movement of the outer end of the arm or lateral swinging movement of the arm from said rest position, whereby the same spring resists movement of the arm about both of said axes.

2. A boat mooring device as claimed in claim 1, wherein the said base is telescopically adjustable to vary the overall height of the boat mooring device, and comprises inner and outer tubular members in vertically telescoping relationship with respect to one another, and means for securing the members in a telescopically adjusted position.

3. A boat mooring device as claimed in claim 1, wherein the base is telescopically adjustable to vary the overall height of the boat mooring device, and comprises inner and outer tubular members in vertically telescoping relationship with respect to one another, and means for securing the members in a telescopically adjusted position, wherein said outer telescoping member forms an upper part of said base and said inner telescoping member forms a lower part of said base, and wherein said coil spring is connected between said inner end of the arm and said outer telescoping member so that the spring rate does not change in response to adjustment of the height of the base.

4. A boat mooring device as claimed in claim 1, wherein said coil spring is provided with a protective sleeve covering the coils of the spring.

5. A boat mooring device as claimed in claim 1, wherein said arm is of a shape defined by inner and outer end portions having axes which are parallel and an intermediate portion defining respective obtuse angles with respect to the end portions, and wherein the arm is disposed, in said rest position, with said end portions generally horizontal and the outer end portion at an elevation above the inner end portion.

6. A boat mooring device as claimed in claim 5, wherein the arm comprises a single length of metal tubing bent to define said shape.

7. A boat mooring device as claimed in claim 1, wherein said coupling means comprises a yoke pivotally coupled to the base for turning about said upright axis, the yoke having a pair of spaced limbs extending upwardly from the base and embracing the arm, and wherein the arm is coupled to said limbs of the yoke for turning about said generally horizontal axis.

8. A boat mooring device as claimed in claim 7, wherein said yoke and base are provided with selectively operable means for positively preventing angular movement of the yoke with respect to the base whereby the mooring device can be locked against undue lateral swinging movement in extreme weather conditions.

9. A boat mooring device as claimed in claim 1, in combination with an extension stand adapted to be coupled between said base and a supporting surface, said extension stand comprising respective inner and outer tubular members coupled together in telescoping relationship and means for securing the members in an adjusted telescoping position with respect to one another.

10. A boat mooring device as claimed in claim 1, in combination with an angle bracket for mounting the boat mooring device at a mooring location, said bracket comprising respective limbs disposed mutually at right angles and means permitting one of said limbs to be secured to a vertical support surface with the other of said limbs extending horizontally of said surface, and means for permitting the base to be coupled to said other limb.

11. A boat mooring device comprising:

a mooring arm for extending between a mooring location and a boat;

a base for supporting the arm at said mooring location;

means coupling the arm to the base so as to permit pivotal movement of the arm with respect to the base about both an upright axis, permitting lateral swinging movement of the arm to accommodate movement of a moored boat towards and away from the mooring location, and about a generally horizontal axis permitting up and down movement of the arm for accommodating up and down movement of the boat; and spring means normally maintaining the arm in a rest position about both of said axes;

wherein said coupling means comprises a yoke pivotally coupled to the base for turning about said upright axis, the yoke having a pair of spaced limbs extending upwardly from the base and embracing the arm, and wherein the arm is coupled to said limbs of the yoke for turning about said generally horizontal axis.

* * * * *